United States Patent [19]

Wallace

[11] Patent Number: 4,563,921

[45] Date of Patent: Jan. 14, 1986

[54] COMPACT PLIERS WITH LARGE, ADJUSTABLE JAW SPAN

[76] Inventor: John Wallace, 287 Elliot St., #12, Newton, Mass. 02164

[21] Appl. No.: 708,498

[22] Filed: Mar. 5, 1985

[51] Int. Cl.[4] ..... B25B 7/12

[52] U.S. Cl. ..... 81/373

[58] Field of Search ..... 81/367, 373, 352, 312, 81/346

[56] References Cited

U.S. PATENT DOCUMENTS 3,210,070 10/1965 Lagana ..... 81/373

FOREIGN PATENT DOCUMENTS 1280557 7/1972 United Kingdom ..... 81/373

*Primary Examiner*—James L. Jones, Jr.

*Attorney, Agent, or Firm*—Shlesinger Fitzsimmons Shlesinger

[57] ABSTRACT

The pliers include a frame having a hand grip portion and two, spaced, laterally projecting leg sections. At least one of the leg sections is fixed to the hand grip portion of the frame and has formed thereon a stationary jaw, which confronts a movable jaw that is carried by a support member that is mounted on the frame to extend transversely between its leg sections, and for reciprocation generally parallel to its hand grip portion. The support member is connected to a handle, which is pivotally mounted on the frame to reciprocate the movable member and its jaw in opposite directions, thereby to shift the movable jaw toward and away from the stationary jaw. The movable jaw is mounted on its support member for adjustment thereon into any one of a number of different positions, thereby to adjust the span between the jaws. In one embodiment both leg sections are fixed relative to the hand grip portion, and in another embodiment one of the leg sections comprises a link which pivotally connects one end of the hand grip portion to the adjacent end of the movable jaw supporting member. In still another embodiment an over-center clamping means is interposed between the frame and the handle in order to releasably to secure the movable jaw in an operative, clamping position.

16 Claims, 7 Drawing Figures

COMPACT PLIERS WITH LARGE, ADJUSTABLE JAW SPAN

BACKGROUND OF THE INVENTION

This invention relates to pliers, and more particularly to improved such pliers of both the (Vise Grip) and non-(Vise Grip) varieties which have large, adjustable jaw spans.

Heretofore most pliers of conventional design have utilized a pair of pivotally connected levers for swinging a pair of clamping jaws toward and away from one another. Such prior art includes so-called vise-type pliers, which are generally similar in configuration and operation to conventional pliers, except that they include a latching or over-center device for locking the jaws against movement once they have been clamped in place around a workpiece. Moreover, at least some such prior devices have included some means for adjusting the maximum spacing or span between jaws.

For example U.S. Pat. No. 3,092,378 discloses a clamping device having at least one adjustable jaw. Although U.S. Pat. No. 1,406,032 shows a vise-type device, its jaw span is not adjustable; and although U.S. Pat. No. 63,356 discloses a pliers-type device with a large jaw span, nevertheless neither jaw is adjustable. Other varieties of pliers or clamping devices are disclosed in U.S. Pat. Nos. 851,794; 3,210,070; 2,995,794; 1,151,772 and 1,380,044, but they do not disclose jaw clamping and adjusting means which enable jaw span adjustment without altering the leverage ratio of the devices Still another disadvantage of most prior pliers has been the fact that their jaw operating levers usually are pivoted together or fulcrumed intermediate their ends, so that the amount of gripping force which can be applied to the workpiece is rather restricted.

It is an object of this invention, therefore to provide improved, compact pliers which have unusually large, adjustable jaw spans.

Still another object of this invention is to provide improved pliers of the type described which have lever ratios at least equal to or greater than conventional pliers, and which have at least one jaw which can be adjusted to vary the jaw span without altering the the lever ratio of the pliers.

A further object of this invention is to provide improved pliers of the type described which are capable of functioning as conventional pliers, or which can be produced in a vise-grip format, so that they can be used both for gripping and clamping purposes.

Other objects of the invention will be apparent hereinafter from the specification and from the recital of the appended claims, particularly when read in conjunction with the accompanying drawings.

SUMMARY OF THE INVENTION

In one embodiment a metal strap member, which has a first clamping jaw adjustably mounted thereon, is slidably guided at opposite ends thereof for reciprocation in openings formed in the legs of a generally C-shaped frame member. A lever, which is pivotally mounted intermediate its ends on the frame member, is pivotally connected to one end of the strap member in order to reciprocate the strap member in opposite directions, thereby to shift the first jaw selectively toward or away from a second jaw integral with one of the legs on the frame member. The first jaw is adjustable on the strap member into any one of a number of different positions thereon thereby to adjust the maximum span between said jaws, but without altering the moment or leverage which is applicable by the lever on the jaw-bearing strap member.

In a second embodiment an over-center or clamping mechanism is interposed between the lever and frame member to form a (Vise Grip) function for the pliers; and in another embodiment the pivot point between the lever and jaw bearing strap is adjustable to enable adjustment of the moment arm between the lever and strap, and hence the lever ratio of the pliers.

THE DRAWINGS

DETAILED DESCRIPTION OF THE PREFERRED EMBODIMENTS

Figure 2:
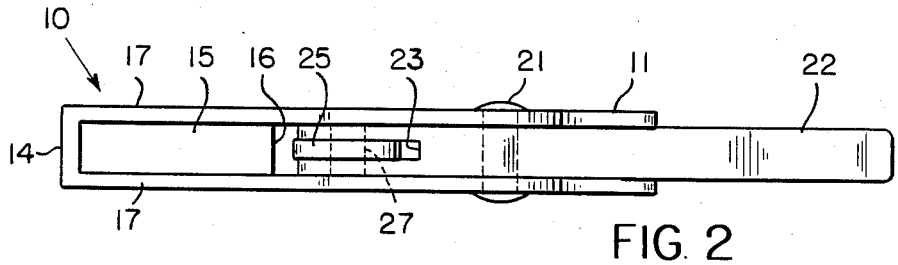
FIG. 2 is a plan view of this set of pliers.

Referring now to the drawings by numerals of reference, and first to FIGS. 1–3, 10 denotes generally a set of pliers comprising a rigid, generally C-shaped hand grip or frame member 11 having at one end thereof (the lower end in FIG. 1) a generally right angularly projecting leg section 12 which has therethrough adjacent its outer end an elongate guide slot 13. At its opposite end frame member 11 has thereon another right angularly extending leg section 14, which is disposed generally parallel to the leg section 12, and which has formed on the underside of its outer end a stationary clamping surface or jaw 15. Intermediate its ends the leg section 14 has therethrough an elongate slot 16, which communicates with the space between a pair of upstanding wing flanges 17, which are integral with, and which project upwardly from, the longitudinal side edges of leg section 14.

Mounted adjacent one end thereof (the upper end in FIG. 1) to pivot about a pin 21, which extends transversely between the wing flanges 17 rearwardly of the slot 16 is a pivotal operating lever or handle 22. The upper end of handle 22 has therein a slot 23, which overlies slot 16 in section 14, and which normally registers with the slot 13 in the lower leg section 12. A rigid strap or movable jaw support 25 has one end thereof slidably guided in the slot 13 in the frame section 12, and projects slidably at its opposite end through the slot 16 in the section 14, and into the space 23 in the outer end of lever 22 where it is pivotally connected to the lever by a pin 27. As a consequence, when the lever 22 is pivoted about its pin or fulcrum 21 the strap member 25 is caused to reciprocate substantially vertically relative to the frame member 11. However, since there is always at least some slight swinging or pivotal movement imparted to member 25 about its lower end by the handle 22 the slots 16 and 23 are made large enough to accommodate such movements.

Adjustably mounted on member 25 is a movable jaw member 31, which has at one end thereof (right end in FIG. 1) a pair of integral, spaced, parallel wing flanges 32, which extend along opposite sides, respectively, of the support member 25. Secured to and extending between the outer ends (the right ends) of the flanges 32 is a cylindrically shaped pin 33, which is disposed to be releasably seated in any one of a plurality of arcuate notches or recesses 35, which are formed in the rear or inside edge of the member 25, or the edge thereof facing frame member 11.

Figure 1:
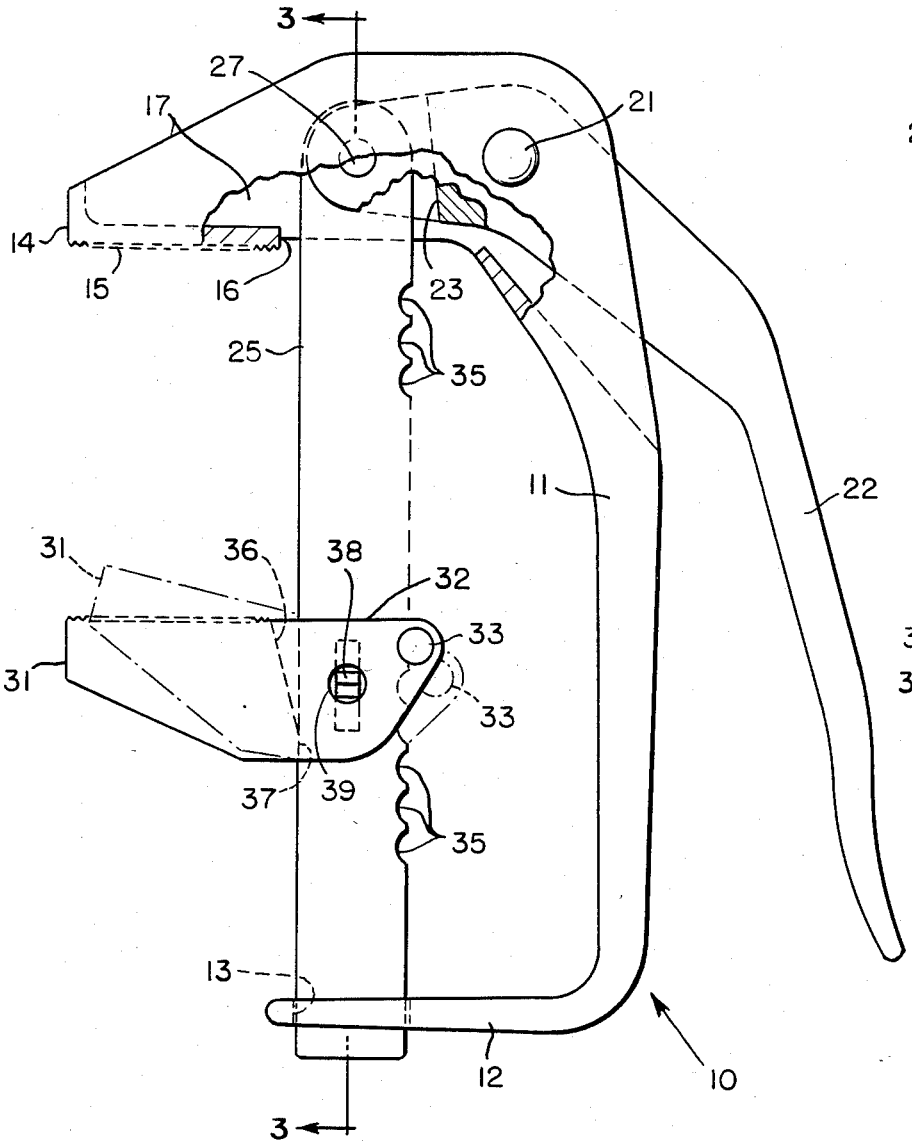
FIG. 1 is a side elevational view of an improved set of pliers made according to one embodiment of this invention, portions of the pliers being cut away and shown in section.

As shown more clearly in FIG. 1, the bottom of the slot which is formed in the jaw 31 by its wing flanges 32 has formed thereon a pair of intersecting bearing surfaces 36 and 37. Normally the bearing surface 37, which is offset beneath the pin 33 as shown in FIG. 1, is disposed to be seated in engagement with the confronting surface on the jaw support 25, when the pin 33 is fully seated in one of the recesses 35. In this position any counterclockwise moment of force exerted upon the upper, clamping surface of the lower jaw 31 would be resisted by the engagement of the pin 33 in the associated slot 33, and the engagement of the bearing surface 37 against member 25.

Whenever it is desired to shift the jaw 31 vertically on member 25 in order to adjust the operating span between jaws 15 and 31, the jaw 31 can be titled manually slightly clockwise from its position as shown in FIG. 1 in order to engage the second bearing surface 36 with the member 25, at which time the jaw 31 will have been tilted into its released or broken line position as shown in phantom by broken lines in FIG. 1. In this position the pin 33 is disengaged from the member 25 so that the jaw 31 can be shifted up or down on member 25 thereby to adjust the maximum span between the upper and lower jaws 14 and 31, respectively. When the desired position is reached the jaw 31 is then tilted again slightly counterclockwise to reengage the pin 33 with the selected slot or groove 35 in member 25. In order releasably to retain jaw 31 in this or any other adjusted position, a leaf spring 38 is interposed between the member 25 and one of the wing flanges 32 with a bowed, central portion of the spring projecting through a registering opening 39 in the associated flange 32, whereby this spring provides sufficient friction to hold the jaw 31 against any undesirable movement when the latter is not grippingly engaged with an object.

In use, the jaw 31 is adjusted on the member 25 as noted above, after which the workpiece that is to be gripped (not illustrated) is interposed between jaws 15 and 31, which have thereon confronting, knurled surfaces as shown more clearly in FIG. 1. The operator then grasps the frame or hand grip 11 and handle 22 in such manner that the handle is pivoted clockwise about pin 21, thereby causing the jaw supporting member 25 to be shifted upwardly, and in turn causing the lower jaw 31 to be advanced toward the upper, stationary jaw 15. In this manner the workpiece can be gripped firmly between the jaws.

Because of the relatively short distance between the pins 21 and 27, as compared to the length of the handle or operating arm 22, the lever ratio (moment arm exerted by one's hand to lever 22 as compared to the moment arm from pin 21 to pin 27) of the pliers during use is very high, and it is therefore possible to transmit to pin 27 a very large moment, and in turn to impart to member 25 a considerable amount of tensile force and consequent gripping pressure on jaw 31. Moreover, it will be noted that substantially all motion takes place in the plane of the C-shaped frame member 11, or transversely of the axes of pins 21, 27 and 33, and that the above-noted lever ratio remains constant regardless of the position of jaw 31 on member 25. Also as noted above, since the lower jaw 31 is subjected to a counterclockwise torque, which tends to force the pin 33 into one of the notches or groove 35 at the back of the support member 25, the jaw will be held securely against movement during a gripping operation.

Figure 5:
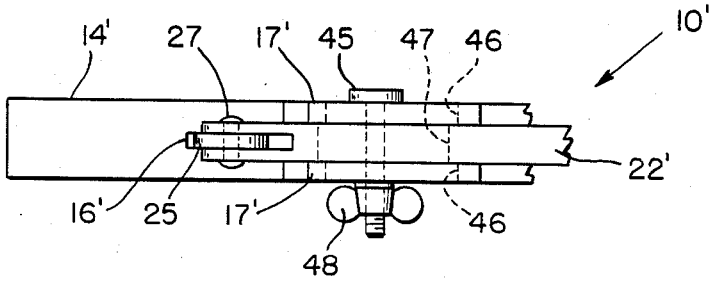
FIG. 5 is a fragmentary plan view of the pliers shown in FIG. 4.
Figure 4:
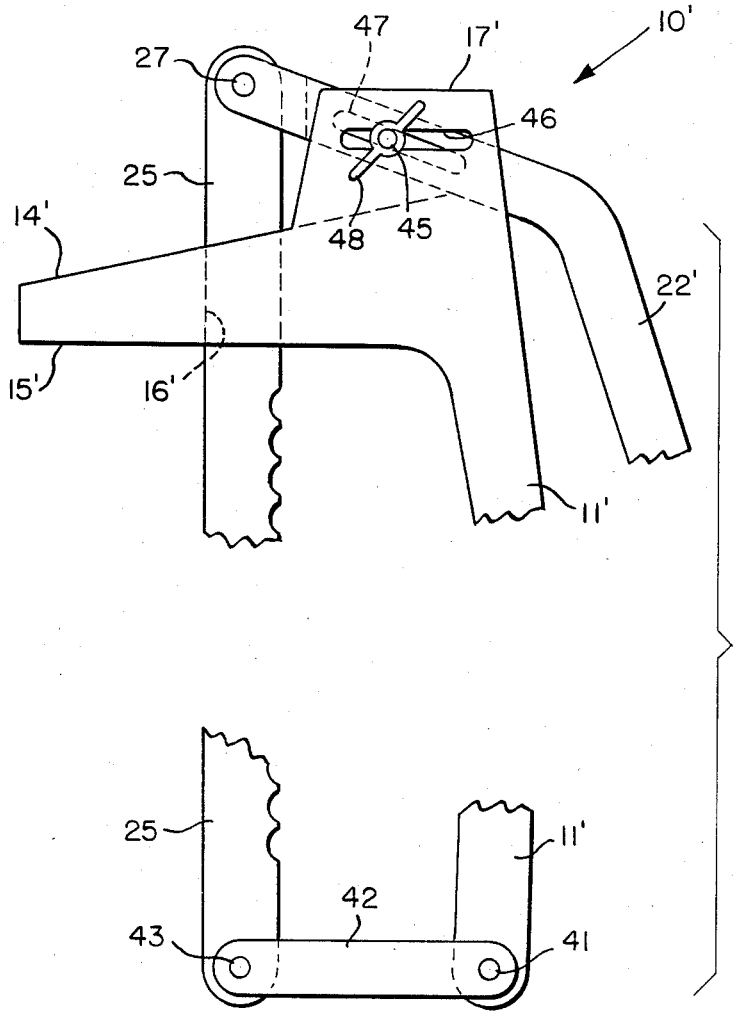
FIG. 4 is a fragmentary elevational view of a modified form of these pliers.

In FIGS. 4 and 5, where like numerals are employed to note elements similar to those employed in the first embodiment, 10' denotes a modified form of pliers having a slightly different hand grip or frame member 11' which is generally of inverted L-shaped configuration. Member 11' has on its upper end an integral, laterally extending leg section 14', which forms the upper jaw 15' of pliers 10', and has in its lower end a pin 41 which is pivotally connected by a link 42 to another pin 43, which is carried on the lower end of the jaw supporting member or strap 25. The upper end of this member 25 extends slidably through an opening 16' in the jaw 15', and into registry with a space which is formed between a pair of integral wing flanges 17', which project upwardly from the side edges of jaw 15', adjacent to its inner or right end as shown in FIG. 4.

The upper end of member 25 is pivotally connected by a pin 27 to the upper end of an operating leaver or handle 22', which is pivotally mounted intermediate its end on frame 11' by a headed bolt 45, the shank of which extends through registering slot 46 and 47 that are formed in the opposed wing flanges 17' and lever 22', respectively. The shank of bolt 45 has adjustably threaded on the end thereof remote from its head a wing nut 48, by means of which the bolt can be adjusted into different positions in the slots 46 of the supporting flanges 17'. Also, because of slot 47, lever 22 is mounted for both pivotal and sliding movement on the shank of the bolt 45, so that during pivotal operation of the lever it is free to shift with translational movement relative to frame 11' when necessary. As a consequence it is possible to make the vertical opening 16' in the upper jaw 15' just large enough to permit vertical sliding movement of the member 25. This contrasts with the first embodiment, wherein lever 25 is mounted for both vertical reciprocal movement, and for some swinging movement in the plane of frame 11.

One of the advantages of the embodiment shown in FIGS. 4 and 5 is that by momentarily loosening the wing nut 48, the bolt 45 can be shifted into any one of several different positions in the flange slots 46, thus permitting the above-noted lever ratio to be adjusted thus to permit the application of either more or less compressive force on work (not illustrated) clamped between the plier jaws.

Figure 3:
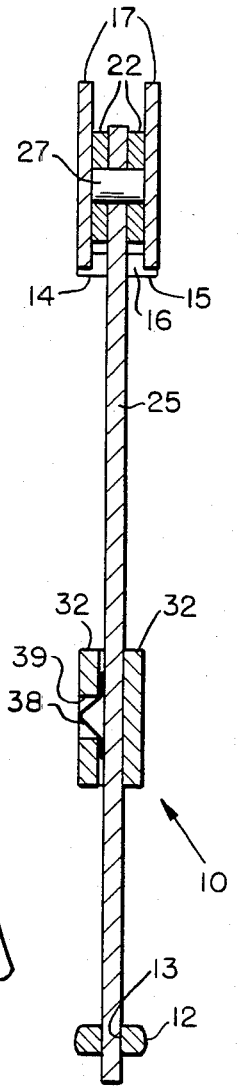
FIG. 3 is a sectional view taken generally along the line 3—3 in FIG. 1 looking in the direction of the arrows.

Although in FIGS. 4 and 5 the link 42 has been used to connect together the lower ends of the body 11' and the operating member 25, it will be readily apparent that this type of link 42 could also be incorporated into the embodiment shown in FIGS. 1–3. As a matter of fact it is particularly suited for pliers 10, wherein jaw supporting member 25 is designed for both vertical and lateral movement relative to frame 11 during operation.

Figure 6:
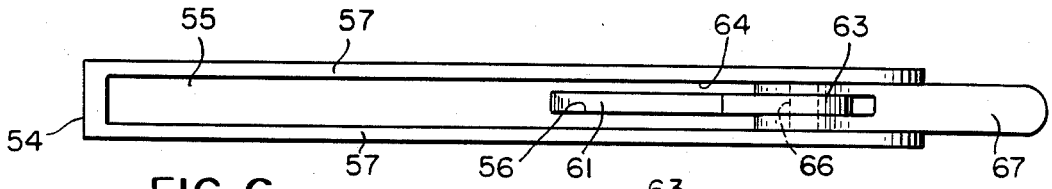
FIG. 6 is an elevational view of a (Vise Grip) form of these pliers made according to another embodiment of this invention.
Figure 7:
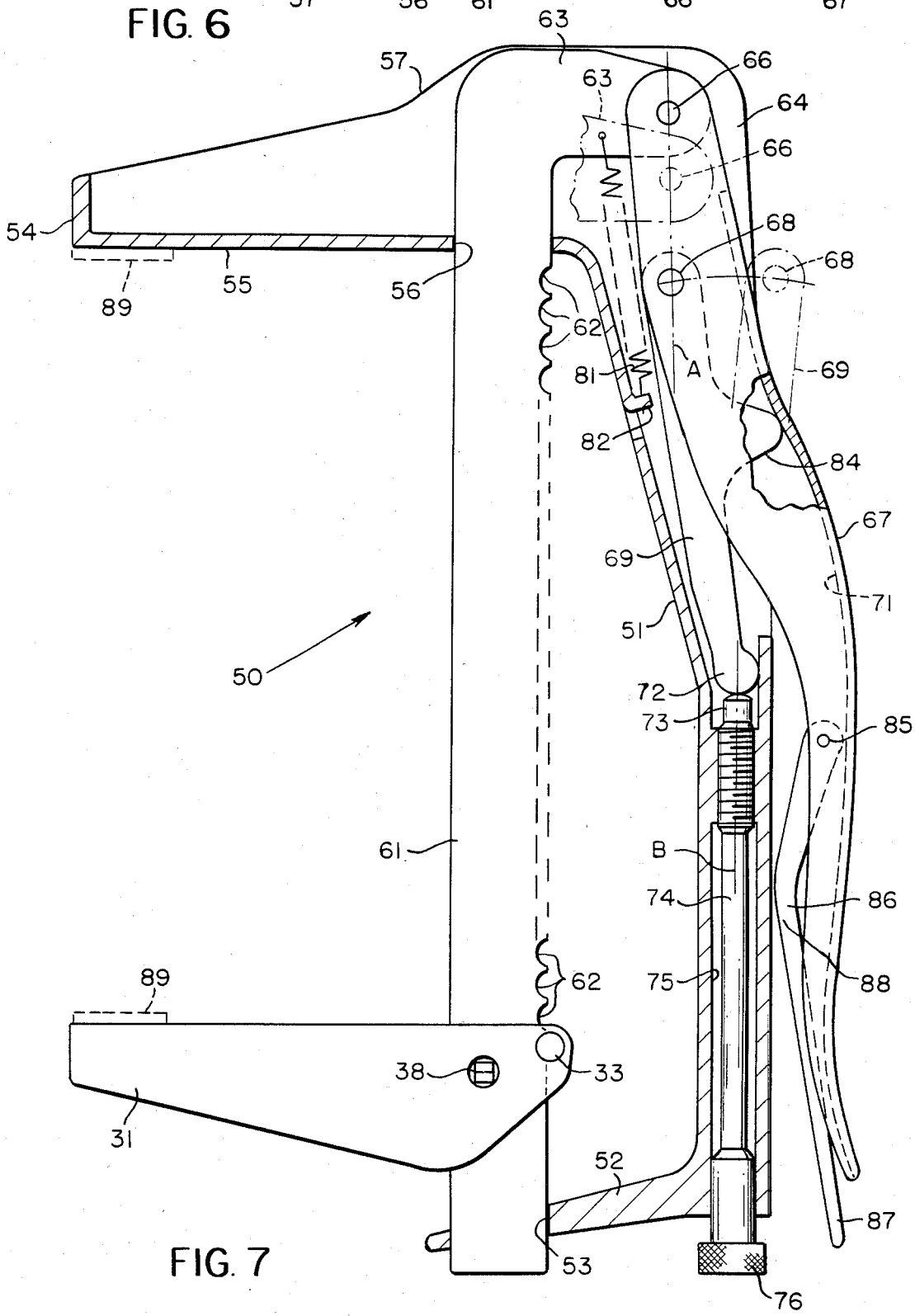
FIG. 7 is a plan view of this other embodiment.

Referring now to the embodiment shown in FIGS. 6 and 7, 50 denotes a (Vise Grip) type of pliers comprising a generally C-shaped frame member or hand grip 51 having at one end an integral, nearly right-angularly projecting leg section 52 containing in its outer end an elongate slot 53. Projecting laterally from the other end of member 51 is a substantially larger leg leg section 54 the outer end of which has formed thereof a stationary clamping surface or jaw 55. As in the first embodiment, the section 54 has intermediate its ends an elongate slot 56, which registers with the space between a pair of upstanding wing flanges 57, which are integral with and project upwardly from the side edges of jaw 55. Also as in the first embodiment, a vertically disposed strap or jaw supporting member 61 is slidably guided at one end (its lower end in FIG. 7) in slot 53, and at its other end in the slot 56 which guides it for vertical motion only.

Intermediate its member ends 61 has in its rear or inner edge a plurality of accurate notches or grooves 62, for engagement by a pin 33, which is carried by a jaw 31, which is mounted on member 61 in a manner similar to the manner in which the correspondingly numbered jaw 31 is mounted on member 25 in the first embodiment. Unlike the first embodiment, however, member 61 has at its upper end a right-angular projection 63, which extends rearwardly or away from the jaw 55 into an elongate recess 64 formed in the upper end of member 51 to communicate with the space between the wing flanges 57. The projection 63 of member 61 is pivotally connected by a pin 66 to the upper end of a pivotal operating handle or lever 67, which is pivotally connected intermediate its ends by a pin 68 to the upper end of a link 69 that projects at its upper end (FIG. 7) into an elongate recess 71 formed in the inner surface of lever 67.

On its opposite (lower) end link 69 has formed thereon a rounded head section 72, which seats upon, or bears against, the reduced diameter upper end 73 of an adjusting screw 74, which is threaded into an elongate bore 75 in the frame member 51 with the head 76 of the screw disposed externally of member 51 at its lower end.

Normally the jaw supporting member 61 is urged resiliently into its lower-most position as shown fragmentarily and in phantom by broken lines in FIG. 7, by means of a tension spring 81, which is positioned in the recess 64 with its upper end attached to the upper end 63 of member 61, and with its lower end secured to a tang 82 that is struck up from frame member 51 at the bottom of its recess 64. When the handle 67 is in its retracted or clamping position as shown in full by solid lines in FIG. 7, the bottom of its recessed surface 71 engages a generally nose-shaped projection 84 that is formed on the link 69 to project from the right-hand side thereof as shown in FIG. 7. In this position the axes of the pins 66 and 68 lie in a common plane, which as shown at A in FIG. 7 lies to the left of the axis B of screw 74 and the point of engagement between the upper end 73 of the screw and the head 72 on link 69. As a consequence, the spring 81 has an over-center latching effect on the link 69 since the moment imparted to link 69 as a result of the downward pressure exerted by the spring 81 tends to urge link 69 in a counterclockwise direction about its head 72 in this position.

When the handle 67 is swung counterclockwise from its solid line position shown in FIG. 7 to a jaw opening or release position, the pin 68, and hence the link 69, are caused to be swung clockwise about the rounded head 72 of the link, and into the broken line positions as shown in phantom in FIG. 7. Also at this time the pin 66 and the upper end of the operating member 61 are shifted vertically downward to their broken line positions (FIG. 7), whereby member 61 is also lowered to lower the jaw 31 and to release any work formerly clamped between the jaws. At this time the spring 81 urges the operating member 61 downwardly and resiliently into its lowermost position (not illustrated). The handle 67 is thereafter retained in its open position by spring 81 until such time that it is again forced into its closed position. Spring 81 also maintains the lower end of link 69 against the upper end 73 of screw 74, when the pliers are not gripping an object.

Pivotally connected at one end by a pin 85 to the handle 67 adjacent its lower end is a curved toggle arm 86, wnhich projects at its opposite end as at 87 beneath the lower end of handle 67. Intermediate its ends arm 86 has formed thereon a curved section 88, which is engagable with member 51 when the handle 67 is in its closed or clamping position. To release the handle the lower end 87 of the toggle arm 86 can be urged toward member 51, thus camming the handle 67 counterclockwise about the pin 66 to its released position.

In addition to adjusting the position of jaw 31 on support 61, the span between the jaws 31 and 55 can also be adjusted incrementally between the discrete positions represented by the notches 62 in member 61, by rotating screw 74 in one direction or the other, thus shifting member 61 in a direction either to increase or decrease the pressure exerted by the jaws on an object clamped therebetween. Also, if desired, rubber pads 89, which are shown in phantom by broken lines at 89 in FIG. 7, could be secured to the confronting surfaces of the jaws 31 and 55 to make the pliers suitable for woodworking clamps.

From the foregoing it will be apparent that applicant's novel pliers are capable of being adjusted to provide an exceptionally large span between its jaws without necessarily altering in any way its effective lever ratio. By employing a one-piece, C-shaped frame member or hand grip, as in the embodiments of FIGS. 1–3 and 6, 7, it is possible not only to adjust one jaw relative to the other before clamping a workpiece between the jaws; but also it is possible to apply extremely high, and in some cases adjustable, clamping pressures to the work. Moreover, the member (25,61), which supports the movable jaw, is supported in turn at both of its ends by the C-shaped frame member, in contrast to most prior art pliers in which the moving jaw usually is fixed at one end of a supporting member which in turn is supported only at one end, thus resulting in a cantilevered member which must be made very sturdy in order to provide a structure capable of reducing stresses to a minimum. Since with applicant's pliers the supporting member for the lower jaw is supported at opposite ends thereof, the stresses applied to the member are lower than those normally encountered with the cantilevered type of supports. As a consequence the pliers can be made lighter since they will require less material to produce the required support.

A further advantage of this type of adjustable plier is that the adjustable jaw can be shifted very rapidly and easily across its entire adjustable span, simply by shifting it longitudinally into different positions on its associated supporting member 25 or 61, and in the case of pliers 50, by adjusting the span between such positions by virtue of screw 54. Moreover, with the embodiment shown in FIGS. 4 and 5, the lever ratio of the pliers can be readily adjusted if necessary. And it will be apparent that this type of pliers is readily adaptable to the manufacture of vise-gripping devices such as shown in FIGS. 6 and 7. Furthermore, while this invention has been illustrated and described in detail in connection with only certain embodiments thereof, it will be readily apparent that it is capable of still further modification, and that this application is intended to cover any such modifications as may fall within the scope of one skilled in the art or the appended claims.

I claim:

1. Adjustable pliers, comprising a first member having thereon an elongate hand-grip portion, an elongate second member, means supporting said second member adjacent opposite ends thereof on said first member for reciprocation generally parallel to the hand-grip portion of said first member, a first jaw secured to and projecting transversely from said first member adjacent one end thereof, a second jaw projecting from said second member and having on one end thereof a plane operating surface disposed in spaced, confronting relation to a corresponding operation surface on said first jaw, said supporting means comprising a handle connected at one end to said second member, means pivotally connecting said handle intermediate its ends to said first member for swinging movement relative thereto in opposite directions, thereby to reciprocate said second member and to shift said second jaw toward and away from said first jaw, and means mounting said second jaw on said second member for longitudinal adjustment thereon into any one of a plurality of different operating positions.

2. Adjustable pliers as defined in claim 1, wherein said supporting means further comprises a first projection integral at one end with said one end of said first member, and having said first jaw formed on the opposite end thereof, said second member projects at one end slidably through an opening in said first projection between said first jaw and said one end of said first member, and a pin pivotally connects said one end of said second member to said one end of said handle.

3. Adjustable pliers as defined in claim 2, wherein said supporting means further comprises a second projection integral at one end with, and extending laterally from, said first member at the end thereof remote from said first projection, and the opposite end of said second member is slidably guided in an opening formed in said second projection to register with said opening in said first projection.

4. Adjustable pliers as defined in claim 2, wherein said supporting means further comprises a link pivotally connecting together the ends of said first and second members remote from said first projection.

5. Adjustable pliers as defined in claim 2, wherein said means connecting said handle to said first member comprises a second pin connecting said handle intermediate its ends to said first member for pivotal movement relative thereto about an axis which extends parallel to and is spaced from the axis of said first pin, and means supporting said second pin on said first member for adjustment selectively toward and away from the first-named pin, thereby to adjust the force which is applicable by the handle to said second member.

6. Adjustable pliers as defined in claim 2, wherein said means connecting said handle to said first member comprises a second pin mounted in said handle in spaced, parallel relation to said first pin, and means connecting said second pin to said first member for limited swinging movement relative thereto about a third axis spaced from and parallel to the axes of said first and second pins, and into and out of an operative position in which said second member is moved thereby in a direction to shift said second jaw into a clamping position relative to said first jaw.

7. Adjustble pliers as defined in claim 6, wherein the last-named connecting means comprises a link pivotally connected at one end to said second pin, and means adjustably supporting the opposite end of said link on said first member for pivotal movement about said third axis.

8. Adjustable pliers as defined in claim 7, including a spring interposed between said first and second members resiliently to resist swinging movement of said handle relative to second member, and means on said handle for adjusting said link relative to said first member, thereby to move said second member and said second jaw in a direction selectively to increase or decrease the span between said jaws.

9. Adjustable pliers as defined in claim 1, wherein said mounting means comprises a pair of spaced, integral, shoulders projecting from the end of said second jaw opposite to said one end thereof, and flanking opposite sides of said second member intermediate its ends, and a pin extending between said shoulders and transversely across the side of said second member remote from said one end of said second jaw, said second member having in the last-named side thereof a plurality of longitudinally spaced recesses, and said pin being releasably seated in one of said recesses to secure said second jaw against movement on said second member during use of the pliers.

10. Adjustable pliers as defined in claim 9, wherein said opposite end of said jaw has thereon a pair of intersecting, plane surfaces confronting the side of said second member remote from the first-named side thereof, and said second jaw is mounted on said second member for limited pivotal movement between an operating position in which one of said intersecting surfaces is engaged with said second member and said pin is engaged in one of said spaced recesses in the second member, and an adjusting position in which the other of said intersecting surfaces is slidably engaged with said second member and said pin is disengaged from said recesses.

11. Adjustable pliers as defined in claim 10, including resilient means interposed between said second member and one end of said shoulders frictionally to resist the pivotal movement of said second jaw between said operating and adjusting positions, respectively.

12. A clamping device having an adjustable jaw span, comprising a generally C-shaped frame having an elongate hand grip portion and a pair of spaced, generally parallel leg sections projecting laterally from opposite ends, respectively, of said hand grip portion, a movable jaw supporting member mounted on said frame for reciprocation generally parallel to the hand grip portion of said frame, at least one of said leg sections being fixed relative to said hand grip portion of said frame, and having formed thereon a first, stationary jaw, a second movable jaw mounted on said supporting member to confront said first jaw, and movable by said member toward and away from said first jaw, and between clamping and released positions, respectively, relative to a workpiece positioned between said jaws, operating means interposed between said frame and said member for reciprocating the latter between a first position in which said movable jaw is shifted to its clamping position and a second position in which said movble jaw is shifted to its released position, and means adjustably mounting said second jaw on said movable member for adjustment thereon into any one of a number of different positions intermediate the ends of said member, thereby to adjust the distance that separates said jaws when the movable jaw is in its released position.

13. A clamping device as defined in claim 12, wherein both of said leg sections are fixed relative to said hand grip portion of said frame, and said movable member extends through and is slidably guided adjacent opposite ends thereof in registering slots in said leg sections.

14. A clamping device as defined in claim 12, wherein the other of said leg sections comprises a link pivotally connected at opposite ends thereof to said moveable member and to said hand grip portion of said frame adjacent the end thereof remote from said one leg section.

15. A clamping device as defined in claim 12, wherein said operating means includes means mounting said movable member on said frame for limited adjustment relative thereto in a first direction to increase said distance separating said jaws, and in the opposite direction to decrease said distance.

16. A clamping device as defined in claim 15, including means interposed between said frame and said member and resiliently resisting movement of said movable member to said first position.

* * * * *